US010675892B2

(12) United States Patent
Kanda et al.

(10) Patent No.: US 10,675,892 B2
(45) Date of Patent: Jun. 9, 2020

(54) PRINTING APPARATUS

(71) Applicant: Brother Kogyo Kabushiki Kaisha, Nagoya-shi, Aichi-ken (JP)

(72) Inventors: Ryuichi Kanda, Nagoya (JP); Takehiko Inaba, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 134 days.

(21) Appl. No.: 16/044,579

(22) Filed: Jul. 25, 2018

(65) Prior Publication Data

US 2019/0030928 A1 Jan. 31, 2019

(30) Foreign Application Priority Data

Jul. 28, 2017 (JP) ..... 2017-146412

(51) Int. Cl.

| | |
|---|---|
| ***B41J 15/04*** | (2006.01) |
| ***B41J 11/04*** | (2006.01) |
| ***B65H 16/08*** | (2006.01) |
| ***B41J 3/407*** | (2006.01) |
| ***B65H 18/02*** | (2006.01) |
| ***B65H 16/06*** | (2006.01) |

(52) U.S. Cl.

CPC ..... *B41J 15/042* (2013.01); *B41J 3/4075* (2013.01); *B41J 11/04* (2013.01); *B41J 15/046* (2013.01); *B65H 16/06* (2013.01); *B65H 16/08* (2013.01); *B65H 18/028* (2013.01); *B65H 2301/41342* (2013.01); *B65H 2301/41366* (2013.01); *B65H 2402/64* (2013.01); *B65H 2403/411* (2013.01); *B65H 2511/12* (2013.01); *B65H 2801/12* (2013.01)

(58) Field of Classification Search

CPC ..... B41J 15/042
USPC ..... 400/613
See application file for complete search history.

(56) References Cited

U.S. PATENT DOCUMENTS 6,494,631 B1 * 12/2002 Mastinick ..... B41J 33/003 400/206.2
7,896,564 B2 * 3/2011 Heaton ..... B41J 29/023 400/613
10,308,053 B2 * 6/2019 Hirose ..... B41J 29/13
(Continued)

FOREIGN PATENT DOCUMENTS

JP 2008-222364 A 9/2008

*Primary Examiner* — Anthony H Nguyen
(74) *Attorney, Agent, or Firm* — Banner & Witcoff, Ltd.

(57) ABSTRACT

A printing apparatus includes: a main body; a cover; a pair of supporters including a movable supporter; a first urging member configured to urge the movable supporter in an approach direction; an engaging member movable between a separated position and an engaged position; and a second urging member configured to urge the engaging member toward the engaged position. When the cover is in an open state, the engaging member is located at the engaged position by an urging force of the second urging member so as to inhibit movement of the movable supporter in the approach direction. When the cover is in a closed state, the engaging member is located at the separated position against the urging force of the second urging member by contact of the cover with the engaging member so as not to inhibit the movement of the movable supporter in the approach direction.

10 Claims, 11 Drawing Sheets

(56) References Cited

U.S. PATENT DOCUMENTS

| | | | | |
|---|---|---|---|---|
| 2002/0175985 | A1* | 11/2002 | Zevin | B41J 15/02 347/104 |
| 2004/0018035 | A1* | 1/2004 | Petteruti | B41J 3/36 400/88 |
| 2006/0024114 | A1* | 2/2006 | Lyman | B41J 3/36 400/613 |
| 2006/0228148 | A1* | 10/2006 | Tobin | B41J 2/32 400/120.17 |

* cited by examiner

PRINTING APPARATUS

CROSS REFERENCE TO RELATED APPLICATION

The present application claims priority from Japanese Patent Application No. 2017-146412, which was filed on Jul. 28, 2017, the disclosure of which is herein incorporated by reference in its entirety.

BACKGROUND

The following disclosure relates to a printing apparatus.

There is known a printing apparatus configured to hold a roll of a printing medium in the printing apparatus and perform printing on the printing medium drawn from the roll. There is also known a roll-sheet support device configured to support a roll sheet (a roll paper) to be supplied to a printing device. The roll-sheet support device includes a shaft, two guides, and a guide limiter. The shaft extends in the axial direction of the roll sheet. The two guides are moved in the axial direction along the shaft to respectively guide side surfaces of the roll sheet. Coil springs mounted on the shaft urge the respective two guides in directions in which the two guides move closer to each other. The guide limiter is moved into moving paths of the two guides to hold the two guides in a state in which the distance between the two guides is greater than the greatest width of the roll sheet. In the case where the roll sheet is set, an outer circumferential surface of the roll sheet contacts and bends the guide limiter, so that the guide limiter is moved out of the moving paths of the two guides. The two guides are moved toward each other by the urging forces of the respective coil springs. As a result, the two guides are brought into contact with the respective side surfaces of the roll sheet to position the roll sheet.

SUMMARY

In the case of the above-described roll-sheet support device, there is a possibility that the roll sheet, when set, cannot bend the guide limiter, depending upon the outside diameter of the roll sheet to be set. In this case, a user has to manually bend the guide limiter to move the guide limiter out of the moving paths of the two guides. This complicates operations for setting the roll sheet.

Accordingly, an aspect of the disclosure relates to a printing apparatus in which two guides are easily operated to position a roll sheet.

In one aspect of the disclosure, a printing apparatus includes: a main body including an accommodating portion configured to accommodate a roll of a printing medium, the accommodating portion having an opening on one side in an intersecting direction intersecting a widthwise direction of the roll; a cover being openable and closable so as to cover the opening of the accommodating portion; a pair of supporters provided in the accommodating portion and configured to support opposite portions of the roll in the widthwise direction, the pair of supporters including a movable supporter movable in the widthwise direction, the movable supporter being at least one of the pair of supporters; a lock member configured to perform: inhibiting movement of the movable supporter when the cover is in a closed state; and not inhibiting the movement of the movable supporter when the cover is in an open state; a first urging member configured to urge the movable supporter in an approach direction of the widthwise direction, the approach direction being a direction in which the distance between the pair of supporters decreases; an engaging member movable between a separated position at which the engaging member is spaced apart from the movable supporter and an engaged position at which the engaging member is engaged with the movable supporter to inhibit the movement of the movable supporter in the approach direction; and a second urging member configured to urge the engaging member from the separated position toward the engaged position. When the cover is in the open state, the engaging member is located at the engaged position by an urging force of the second urging member so as to inhibit the movement of the movable supporter in the approach direction, which movement is caused by an urging force of the first urging member. When the cover is in the closed state, the engaging member is located at the separated position against the urging force of the second urging member by contact of the cover with the engaging member so as not to inhibit the movement of the movable supporter in the approach direction, which movement is caused by the urging force of the first urging member.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. A printing apparatus 1 is connectable to an external terminal, not illustrated, via a USB (registered trademark) cable. The printing apparatus 1 is configured to print characters, such as letters and figures, on a printing medium based on print data received from the external terminal. The printing medium is a thermal label. The external terminal is a general-purpose personal computer (PC). The printing apparatus 1 is capable of battery-powered operation. The printing apparatus 1 is, for example, attached to a waist belt via a belt clip, not illustrated, and portably used by a user in operation. A lower right side, an upper left side, an upper right side, a lower left side, an upper side, and a lower side in FIG. 1 are respectively defined as a right side, a left side, a rear side, a front side, an upper side, and a lower side of the printing apparatus 1.

Main Body 2 and Cover 3

Figure 1:
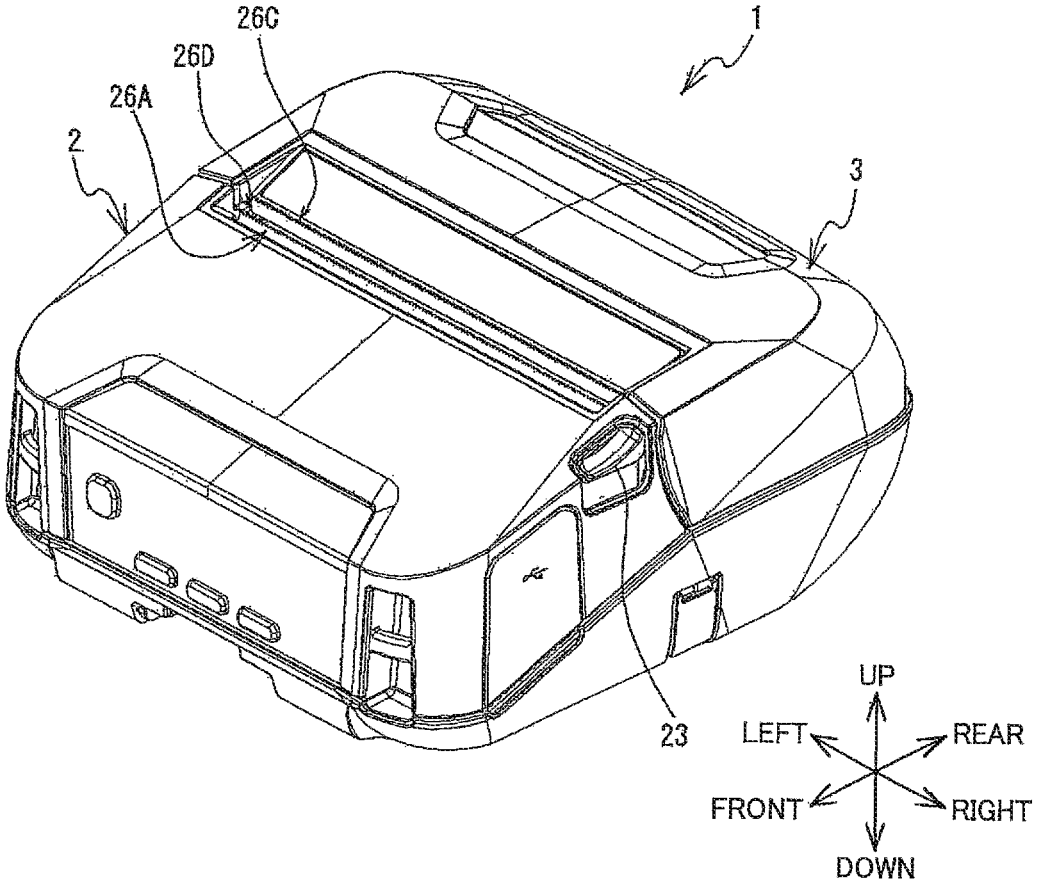
FIG. 1 is a perspective view of a printing apparatus in a state in which a cover is closed.
Figure 2:
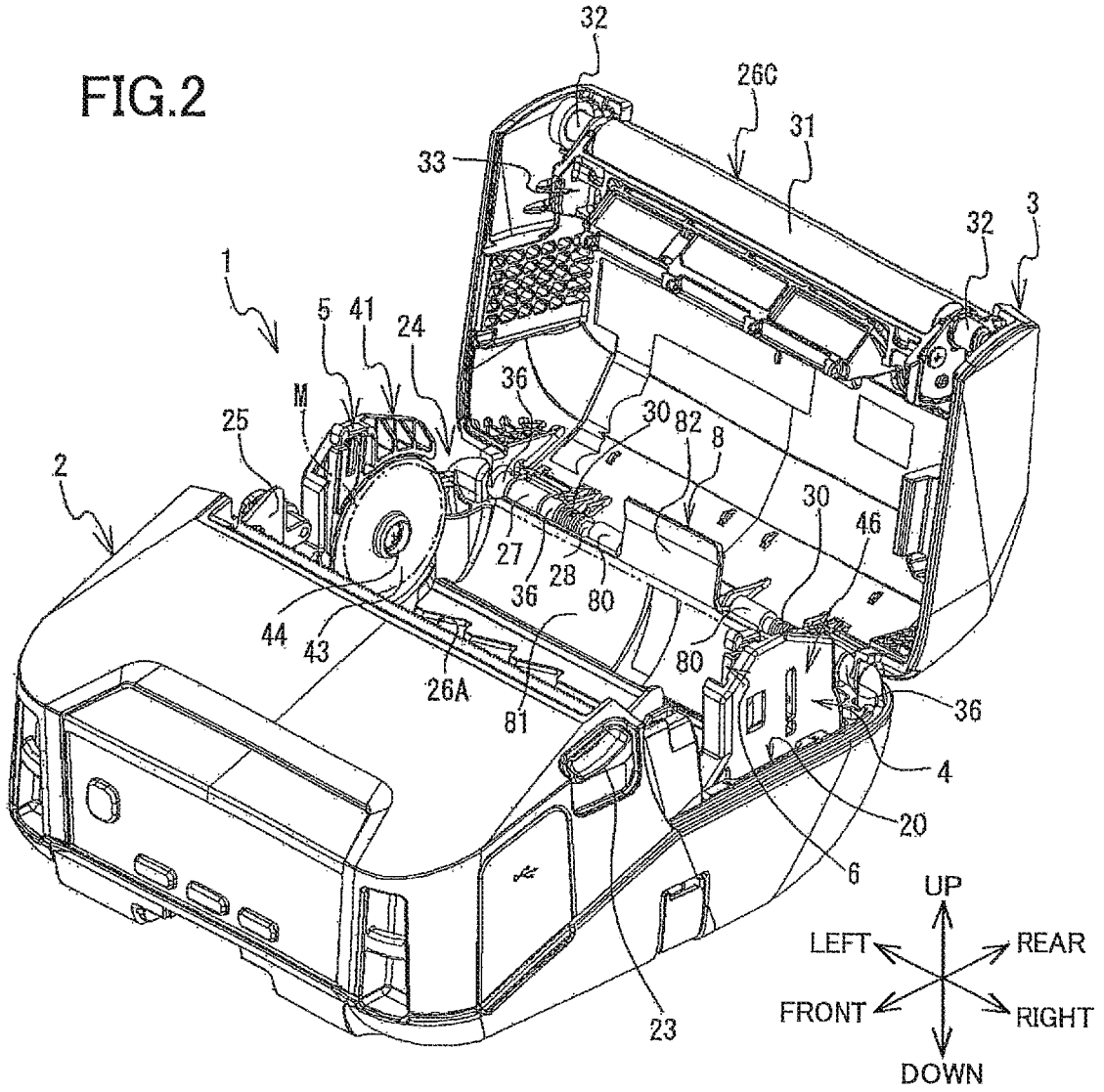
FIG. 2 is a perspective view of the printing apparatus in a state in which the cover is open.

As illustrated in FIG. 1, the printing apparatus 1 includes a main body 2 and a cover 3. The main body 2 is shaped like a box having a substantially rectangular parallelepiped shape. As illustrated in FIG. 2, an accommodating portion 24 is provided at a substantially half of a rear portion of the inside of the main body 2. The accommodating portion 24 is defined by a partition plate, not illustrated, right and left end portions, a rear end portion, and a lower end portion of the main body 2. The partition plate is provided at a substantially center of the main body 2 in the front and rear direction. An upper side of the accommodating portion 24 is open by an opening portion 20 formed in the main body 2. The accommodating portion 24 is capable of accommodating a roll M. The roll M includes a cylindrical core and a tape wound around the core. The tape is constituted by a mount sheet and the thermal labels bonded thereto.

Figure 3:
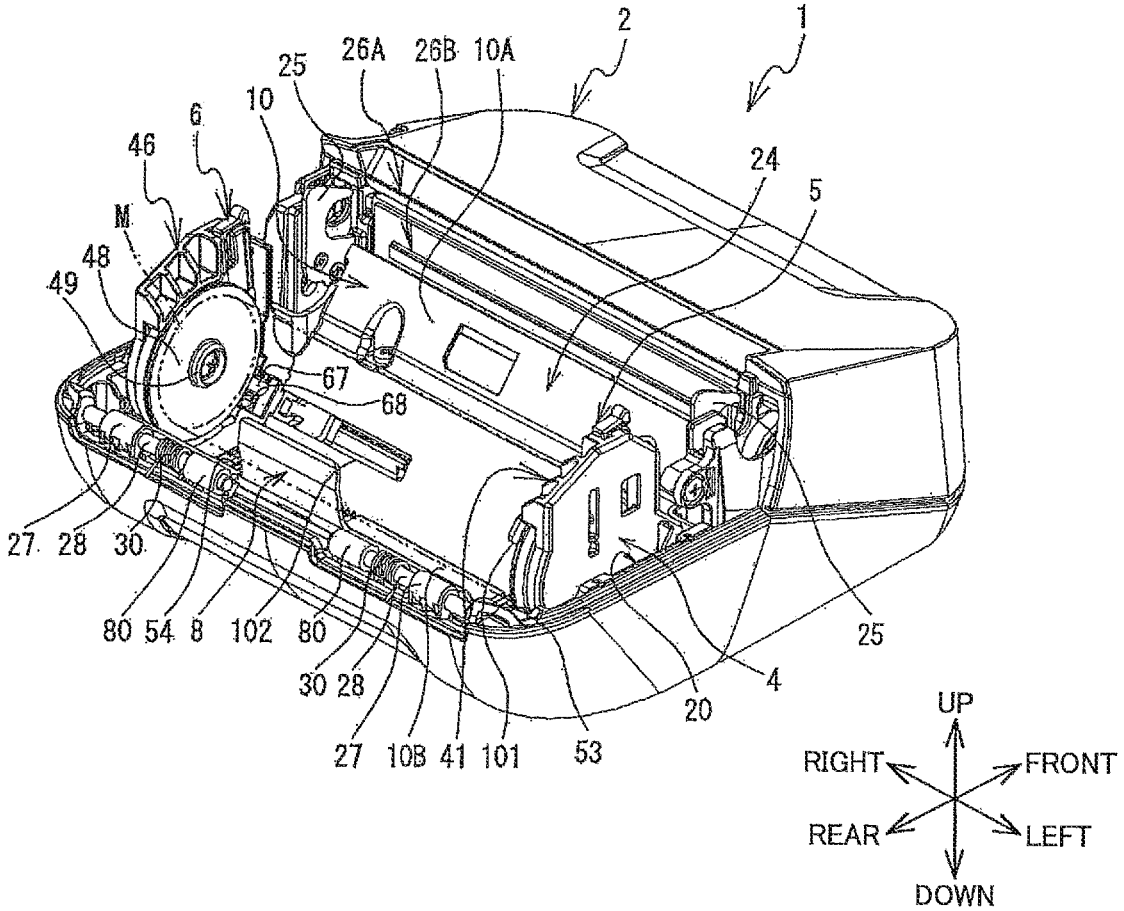
FIG. 3 is a perspective view of an accommodating portion.

As illustrated in FIG. 3, a cutting blade 26A is provided at a front end portion of the opening portion 20 of the main body 2. The cutting blade 26A is capable of cutting the tape so as to separate printed portions of the tape from the other. A thermal head 26B is provided under the cutting blade 26A. The thermal head 26B uses heat to print a character or characters on the thermal label. Each of the cutting blade 26A and the thermal head 26B extends in the right and left direction. Engaging members 25 are provided respectively on right and left end portions of the opening portion 20 of the main body 2. The engaging members 25 are supported such that their respective lower ends are swingable. A lever 23 is provided on a right surface of the main body 2 (see FIG. 1). When this lever 23 is pushed down by a user, an upper end portion of each of the engaging members 25 is moved rearward.

Figure 4:
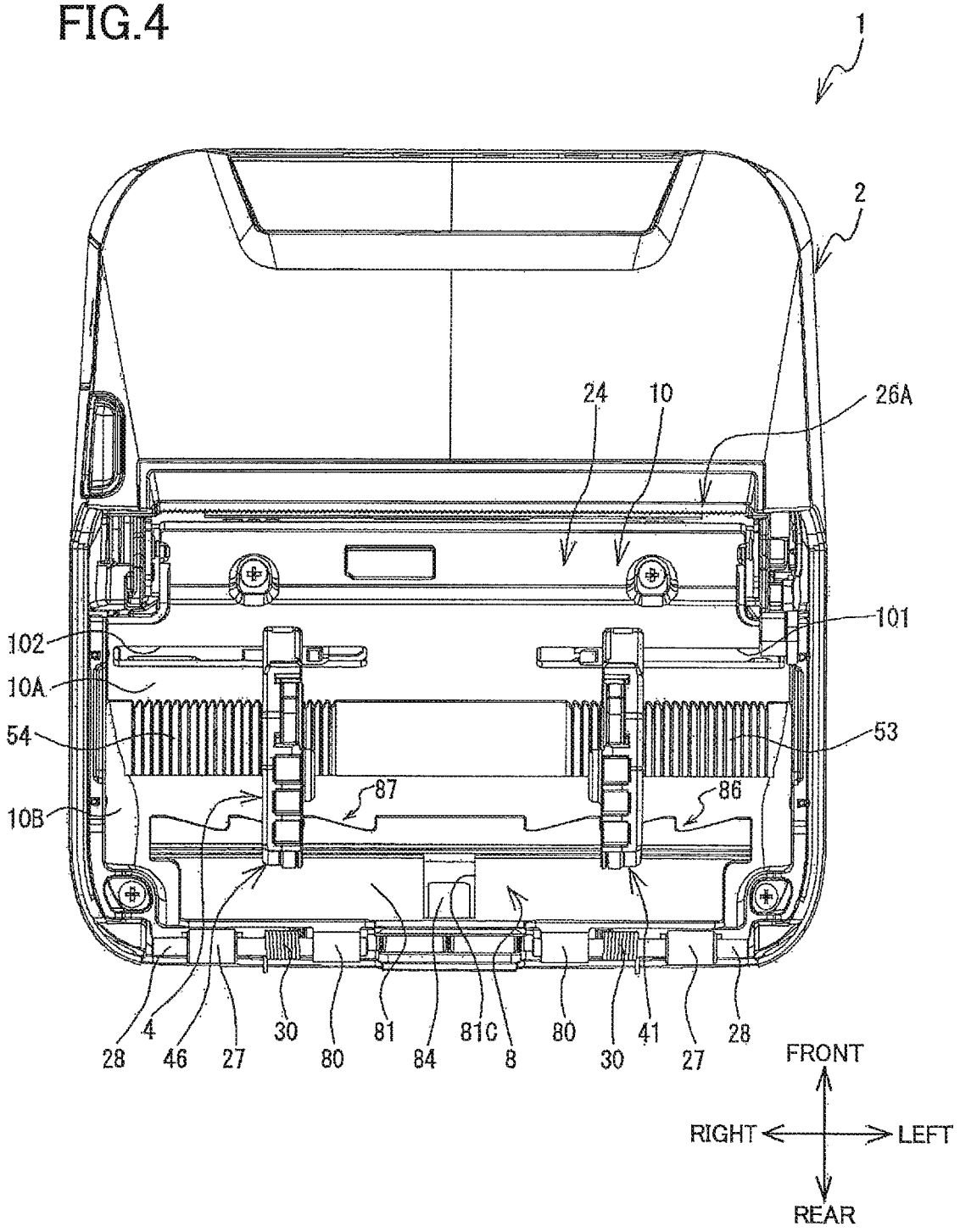
FIG. 4 is a plan view of the accommodating portion.

As illustrated in FIGS. 3 and 4, two supporters 27 protruding upward are provided at a rear end portion of the opening portion 20 of the main body 2. The left supporter 27 protrudes upward from a position near a left end portion of the rear end portion of the opening portion 20. The right supporter 27 protrudes upward from a position near a right end portion of the rear end portion of the opening portion 20. The supporters 27 respectively support support shafts 28 each extending in the right and left direction. The support shafts 28 respectively support two base portions 80 of an engaging member 8, which will be described below, such that the engaging member 8 is pivotable. Springs 30 are provided on outer surfaces of the respective support shafts 28. Each of the springs 30 is located between a corresponding one of the supporters 27 and a corresponding one of the base portions 80. Each of the springs 30 is a torsion coil spring. Each of the springs 30 is provided nearer to the corresponding base portion 80 than to the corresponding supporters 27 in the right and left direction.

As illustrated in FIGS. 1 and 2, the cover 3 is capable of opening and closing the opening portion 20 of the accommodating portion 24. As illustrated in FIG. 2, four protrusions 36 are provided at a rear end portion of the cover 3. Left two of the protrusions 36 are pivotably supported by the support shaft 28 respectively at positions located on opposite sides of the left supporter 27 in the right and left direction. Right two of the protrusions 36 are pivotably supported respectively at positions located on opposite sides of the right supporter 27 in the right and left direction. In FIG. 2, one of the right protrusions 36 is hidden behind a supporter 46 which will be described below. With the configuration described above, the cover 3 is supported by the support shafts 28 provided at a rear end portion of the main body 2, such that the cover 3 is pivotable about the support shafts 28 and not movable in the right and left direction. The cover 3 is pivotable about its rear end portion between a closed state (position) (see FIG. 1) and an open state (position) (see FIG. 2). As illustrated in FIG. 1, the cover 3 in the closed state covers, from above, a part of the accommodating portion 24 which is located under the opening portion 20. The cover 3 in the open state opens the part of the accommodating portion 24 which is located under the opening portion 20. The cover 3 is urged by the springs 30 in a direction in which the cover 3 pivots from the closed state to the open state. In the following description, the sides and directions for the printing apparatus 1 applies to the cover 3 with respect to the cover 3 being in the closed state (see FIG. 1).

As illustrated in FIG. 2, a cutting blade 26C is provided at a front end portion of the cover 3. A platen holder 33 is provided near a front end portion of a lower surface of the cover 3. The platen holder 33 rotatably supports a platen roller 31. A rotation shaft of the platen roller 31 extends in the right and left direction. Cylindrical bearings 32 respectively extend rightward and leftward from right and left end portions of the rotation shaft of the platen roller 31. In the case where the cover 3 is in the closed state, the engaging members 25 are engaged with the respective bearings 32, so that the cover 3 is kept in the closed state (see FIG. 1). In the case where the lever 23 (see FIG. 1) is pushed down when the cover 3 is in the closed state, the engaging members 25 are disengaged from the respective bearings 32. The cover 3 pivots from the closed state to the open state (see FIG. 2) by urging forces of the springs 30.

When the cover 3 is in the closed state, as illustrated in FIG. 1, the cutting blades 26A, 26C are located near to each other, and the thermal head 26B (see FIG. 2) and the platen roller 31 (see FIG. 2) are located near to each other. In the case where the tape is disposed between the platen roller 31 and the thermal head 26B, the platen roller 31 presses the tape against the thermal head 26B (see FIG. 3). The platen roller 31 is rotated by driving of a motor, not illustrated, to convey the tape in the state in which the tape is pressed against the thermal head 26B. When the cover 3 is in the closed state, an output opening 26D is formed between the cutting blades 26A, 26C. The tape printed in the printing apparatus 1 is discharged to the outside through the output opening 26D.

Holder 10

As illustrated in FIG. 3, a holder 10 is fixed in the accommodating portion 24. The holder 10 holds the roll M rotatably in a state in which the widthwise direction of the roll M coincides with the right and left direction. The holder 10 includes fixed portions 10A, 10B, supporters 41, 46 (hereinafter may be referred to as "pair of supporters 4"), lock members 5, 6, a rotation plate 43 (see FIG. 2), a rotation plate 48, and an adjusting mechanism 7 (see FIG. 5).

Each of the fixed portions 10A, 10B has a substantially plate shape. The fixed portion 10A is fixed to the partition plate, not illustrated, corresponding to a front wall of the accommodating portion 24. The fixed portion 10A extends along the partition plate. The direction in which the fixed portion 10A extends is inclined with respect to the horizontal direction. The fixed portion 10A is inclined so as to be lower at its rear end portion than at its front end portion. As illustrated in FIG. 4, the fixed portion 10A has grooves 101, 102 each extending in the right and left direction. The grooves 101, 102 are arranged in a straight line in the right and left direction. The groove 102 is disposed to the right of the groove 101. The grooves 101, 102 are spaced apart from each other in the right and left direction.

The fixed portion 10B is connected to a rear end portion of the fixed portion 10A. The fixed portion 10B extends horizontally along a lower end portion of the main body 2. The fixed portion 10B includes engaging portions 53, 54. Each of the engaging portions 53, 54 has teeth arranged in the right and left direction and each extending in the front and rear direction. The engaging portions 53, 54 are arranged in a straight line in the right and left direction. The engaging portions 53, 54 are spaced apart from each other in the right and left direction. The engaging portion 54 is disposed to the right of the engaging portion 53.

Pair of Supporters 4

Figure 5:
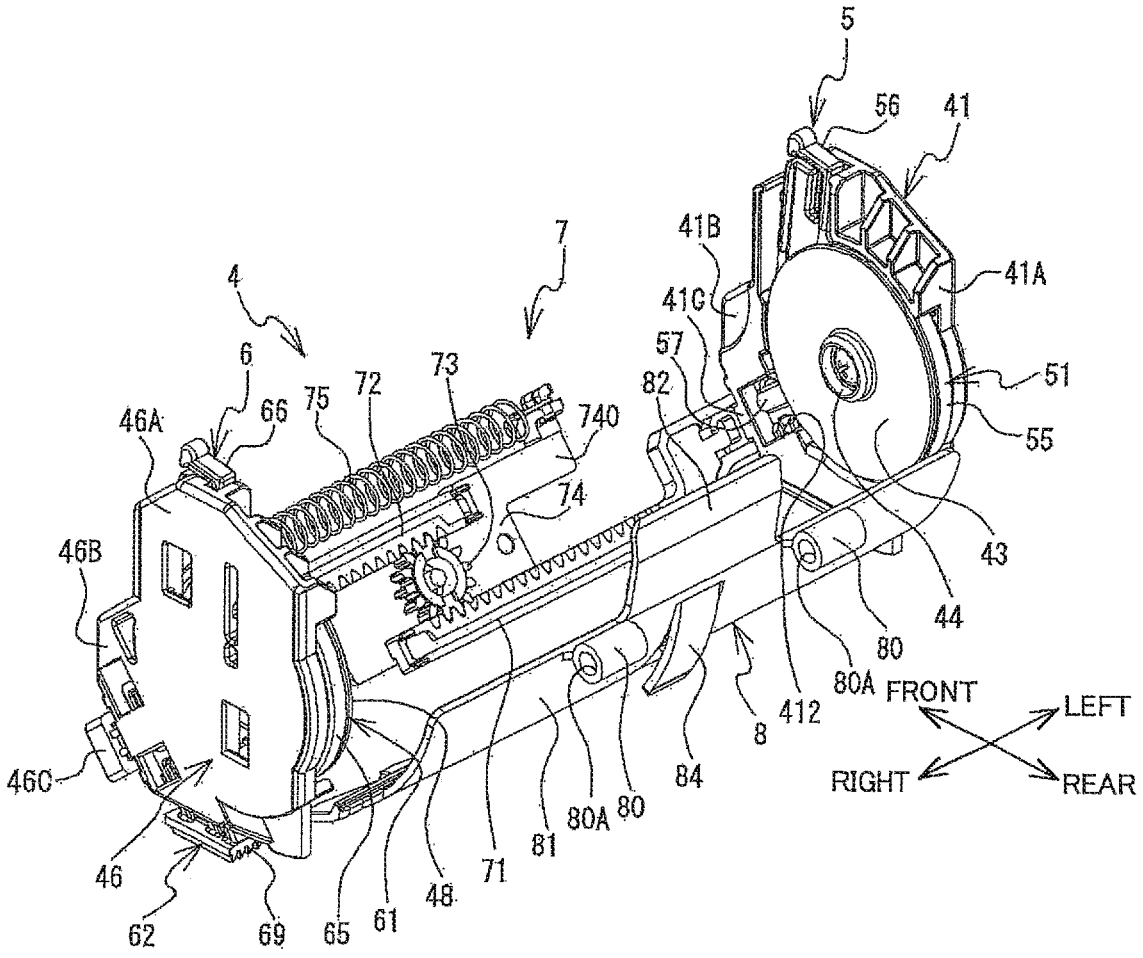
FIG. 5 is a perspective view of a pair of supporters, lock members, and an adjusting mechanism.

As illustrated in FIG. 3, the pair of supporters 4 are disposed at a rear of the fixed portion 10A and above the fixed portion 10B. The supporters 4 are opposed to each other in the right and left direction. As illustrated in FIGS. 2 and 3, the supporters 4 support opposite side portions of the roll M in the right and left direction. The supporter 41 supports the left portion of the roll M, and the supporter 46 supports the right portion of the roll M. The supporter 46 is disposed to the right of the supporter 41. As illustrated in FIG. 5, the supporter 41 and the supporter 46 are symmetrical with respect to a plane orthogonal to the right and left direction and extending at the center between the supporter 41 and the supporter 46 in the right and left direction. In the following description, the supporter 41 will be explained in detail, and the supporter 46 will be explained simply.

Figure 6:
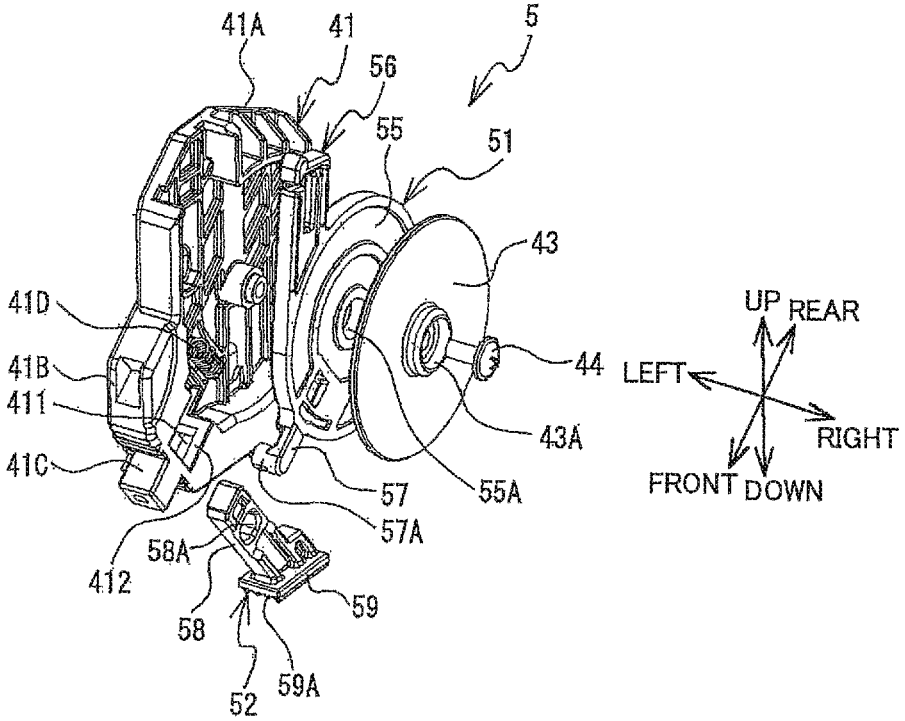
FIG. 6 is a perspective view of the supporter, the lock member, and a rotation plate.

As illustrated in FIG. 6, the supporter 41 includes a base portion 41A, an extending portion 41B, and a protruding portion 41C. The base portion 41A has a substantially plate-like portion orthogonal to the right and left direction. The extending portion 41B obliquely extends toward the lower front side from a part of a front end portion of the base portion 41A, which part is located below a substantially center of the front end portion in the up and down direction. The extending portion 41B has holes 411, 412 through which a portion of the lock member 5, which will be described below, is inserted. The portion of the lock member 5 includes a protruding portion 57A of a first lock member 51 and a base portion 58 of a second lock member 52. An opening of the hole 411 is formed in a lower end portion of the extending portion 41B. The hole 411 obliquely extends toward the upper front side from the lower end portion of the extending portion 41B. An opening of the hole 412 is formed in a right end portion of the extending portion 41B. The hole 412 extends leftward from the right end portion of the extending portion 41B. The hole 412 is connected to the hole 411 in the extending portion 41B.

The protruding portion 41C obliquely protrudes toward the lower front side from a lower front end portion of the extending portion 41B. The protruding portion 41C is inserted in the groove 101 (see FIG. 4), formed in the fixed portion 10A (see FIG. 4), from a rear side of the groove 101 so as to protrude to a position located in front of the fixed portion 10A.

As illustrated in FIG. 5, the supporter 46 includes a base portion 46A, a extending portion 46B, and a protruding portion 46C. The base portion 46A, the extending portion 46B, and the protruding portion 46C correspond respectively to the base portion 41A, the extending portion 41B, and the protruding portion 41C of the supporter 41. The protruding portion 46C is inserted in the groove 102 (see FIG. 4), formed in the fixed portion 10A (see FIG. 4), from a rear side of the groove 102 so as to protrude to a position located in front of the fixed portion 10A.

Adjusting Mechanism 7

As illustrated in FIG. 5, the supporters 4 are moved by the adjusting mechanism 7 in the right and left direction in conjunction with each other. The adjusting mechanism 7 is disposed in front of the fixed portion 10A (see FIG. 4). The adjusting mechanism 7 includes rack gears 71, 72, a pinion gear 73, a support plate 74, and a first urging member 75.

The rack gears 71, 72 are opposed to each other in the up and down direction. The rack gear 72 is disposed above the rack gear 71. Each of the rack gears 71, 72 extends in the right and left direction. Teeth are formed on an upper end portion of the rack gear 71 and on a lower end portion of the rack gear 72. A left end portion of the rack gear 71 is connected to the protruding portion 41C of the supporter 41. A right end portion of the rack gear 72 is connected to the protruding portion 46C of the supporter 46.

The pinion gear 73 is provided between the rack gears 71, 72. The pinion gear 73 is rotatably supported by a part of a front portion of the fixed portion 10A (see FIG. 4), which part is located between the grooves 101, 102. Teeth formed on the pinion gear 73 are engaged with the teeth of the rack gears 71, 72. Each of the rack gears 71, 72 is moved in the right and left direction by rotation of the pinion gear 73. The movement of the rack gears 71, 72 moves the supporters 41, 46 in the right and left direction along the grooves 101, 102 (see FIG. 4). For example, when the supporter 41 is moved leftward by a certain amount, the supporter 46 is moved rightward by the certain amount in conjunction with the movement of the supporter 41 via the rack gear 71, the pinion gear 73, and the rack gear 72. That is, the rack gears 71, 72 and the pinion gear 73 move each of the supporters 4 in a direction in which said each of the supporters 4 moves away from the other (i.e., in an outward direction in the right and left direction which may be hereinafter referred to as "away direction"). When the supporter 41 is moved rightward by a certain amount, the supporter 46 is moved leftward by the certain amount in conjunction with the movement of the supporter 41 via the rack gear 71, the pinion gear 73, and the rack gear 72. That is, the rack gears 71, 72 and the pinion gear 73 move each of the supporters 4 in a direction in which said each of the supporters 4 moves toward the other (i.e., in an inward direction in the right and left direction which may be hereinafter referred to as "approach direction").

The support plate 74 is fixed in front of the pinion gear 73. The support plate 74 has an extending portion 740 extending leftward. The first urging member 75 is provided so as to extend over the extending portion 740 and the rack gear 72. The first urging member 75 is a tension spring. The first urging member 75 applies an urging force to each of the supporters 41, 46 such that each of the supporters 41, 46 moves in the approach direction.

Lock Members 5, 6

As illustrated in FIG. 5, the lock member 5 is provided on the supporter 41, and the lock member 6 is provided on the supporter 46. The lock members 5, 6 are symmetrical with respect to a plane orthogonal to the right and left direction and extending at the center between the lock members 5, 6 in the right and left direction. In the following description, the lock member 5 will be explained in detail, and the lock member 6 will be explained simply.

As illustrated in FIG. 6, the lock member 5 includes the first lock member 51 and the second lock member 52. The first lock member 51 is shaped like a plate. The first lock member 51 includes a base portion 55, a contact portion 56, and a coupling portion 57. The base portion 55 has a substantially round shape. A hole 55A is formed at the center of the base portion 55. A screw 44 is inserted in the hole 55A. The contact portion 56 extends upward from a part of a front end portion of the base portion 55, which part is located above a substantially center of the base portion 55 in the up and down direction. The coupling portion 57 extends obliquely downward from a portion of the base portion 55 which is located below the substantially center of the base portion 55 in the up and down direction. A distal end portion of the coupling portion 57 includes the protruding portion 57A protruding leftward. The protruding portion 57A is shaped substantially like a circular cylinder. The second lock member 52 includes the base portion 58 and an engaged portion 59. The base portion 58 is shaped substantially like a bar. The base portion 58 is inclined such that its lower end portion is located at a rear of its upper end portion. The base portion 58 has a hole 58A near its upper end portion. The hole 58A extends through the base portion 58 in the right and left direction. The engaged portion 59 is provided on a lower end portion of the base portion 58. The engaged portion 59 has teeth 59A at its lower end portion.

As illustrated in FIG. 5, the lock member 6 includes a first lock member 61 and a second lock member 62. The first lock member 61 and the second lock member 62 correspond respectively to the first lock member 51 and the second lock member 52 of the lock member 5. A base portion 65, a contact portion 66, and a coupling portion 67 of the first lock member 61 (see FIG. 3) correspond respectively to the base portion 55, the contact portion 56, and the coupling portion 57 of the first lock member 51. A base portion 68 (see FIG. 3) and an engaged portion 69 of the second lock member 62 correspond respectively to the base portion 58 and the engaged portion 59 of the first lock member 51.

Rotation Plates 43, 48

As illustrated in FIG. 6, the rotation plate 43 is shaped like a round plate. A flat surface of the rotation plate 43 is orthogonal to the right and left direction. The rotation plate 43 is disposed to the right of the base portion 55 of the first lock member 51. The base portion 55 of the first lock member 51 is interposed between the rotation plate 43 and the base portion 41A of the supporter 41. A hole 43A is formed at the center of the rotation plate 43. The screw 44 is inserted in the hole 43A. As illustrated in FIG. 2, the rotation plate 43 contacts a left end portion of the roll M to hold the roll M rotatably.

As illustrated in FIG. 3, the rotation plate 48 is shaped like a round plate. A flat surface of the rotation plate 48 is orthogonal to the right and left direction. As illustrated in FIG. 5, the rotation plate 48 is disposed to the left of the base portion 65 of the first lock member 61. The base portion 65 of the first lock member 61 is interposed between the rotation plate 48 and the base portion 46A of the supporter 46. A hole is formed at the center of the rotation plate 48. As illustrated in FIG. 3, a screw 49 is inserted in the hole. The rotation plate 48 contacts a right end portion of the roll M to hold the roll M rotatably.

Assembling Method

There will be next described a method of assembling the supporter 41, the lock member 5 (the first lock member 51 and the second lock member 52), and the rotation plate 43. It is noted that a method of assembling the supporter 46, the lock member 6 (the first lock member 61 and the second lock member 62), and the rotation plate 48 is the same as the method of assembling the supporter 41, the lock member 5, and the rotation plate 43, and an explanation thereof is dispensed with.

As illustrated in FIG. 6, the base portion 58 of the second lock member 52 is first inserted from below into the hole 411 formed in the extending portion 41B of the supporter 41. The direction in which the hole 411 extends and the direction in which the base portion 58 of the second lock member 52 extends coincide with each other. The second lock member 52 is supported by the supporter 41 so as to be movable along the hole 411. The base portion 55 of the first lock member 51 is disposed near a right surface of the base portion 41A of the supporter 41. In this state, a spring 41D is interposed between the base portion 41A of the supporter 41 and the base portion 55 of the first lock member 51. The spring 41D is a compression coil spring.

The protruding portion 57A of the coupling portion 57 of the first lock member 51 is inserted, from a right side, into the hole 412 formed in the extending portion 41B of the supporter 41. At the same time, the protruding portion 57A of the coupling portion 57 is inserted, from the right side, into the hole 58A of the base portion 58 of the second lock member 52 in the extending portion 41B of the supporter 41. As a result, the coupling portion 57 of the first lock member 51 is coupled to the second lock member 52 (see FIG. 7).

The rotation plate 43 is next placed near a right surface of the base portion 55 of the first lock member 51. The base portion 55 of the first lock member 51 is interposed between the base portion 41A of the supporter 41 and the rotation plate 43 from left and right sides of the base portion 55.

The screw 44 is next inserted, from the right side, into the hole 43A formed at the center of the rotation plate 43. The screw 44 extends through the hole 55A of the base portion 55 of the first lock member 51 and is engaged with the base portion 41A of the supporter 41. The first lock member 51 and the rotation plate 43 are supported by a right surface of the supporter 41 so as to be pivotable and rotatable about the screw 44. That is, the first lock member 51 and the rotation plate 43 are supported by the supporter 41 so as to be independently pivotable and rotatable. The coupling portion 57 pivots in response to pivotal movement of the first lock member 51. In this case, the second lock member 52 coupled via the coupling portion 57 is moved in conjunction with the pivotal movement of the first lock member 51. The spring 41D urges the first lock member 51 in a direction in which the first lock member 51 pivots in the clockwise direction in a state in which the first lock member 51 is viewed from the right side thereof (the state in FIG. 7). In the following description, the rotational direction (the clockwise direction or the counterclockwise direction) of a particular component indicates a direction when the particular component is viewed from the right side unless otherwise specified.

Engaging Member 8

Figure 8:
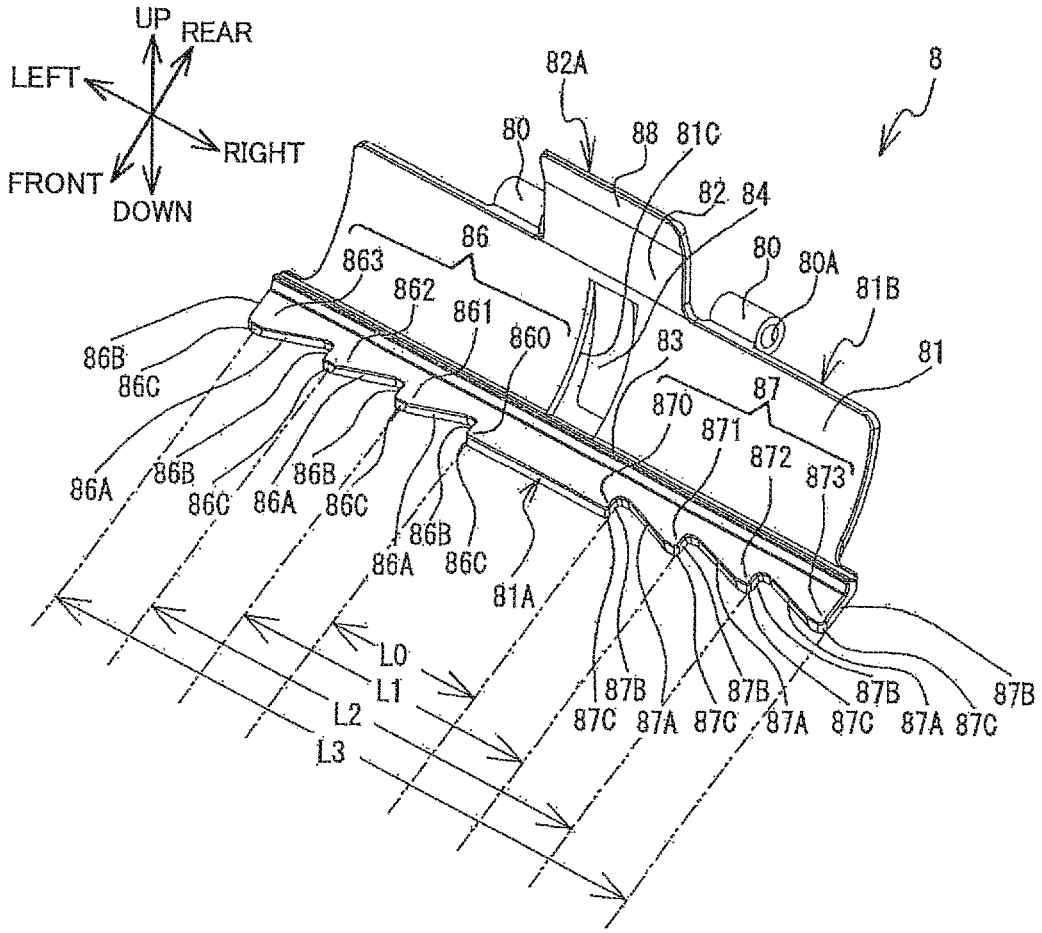
FIG. 8 is a perspective view of the engaging member.

As illustrated in FIGS. 2 and 4, the engaging member 8 is provided in the accommodating portion 24 at a position located at a rear of the supporters 4 and above the fixed portion 10B. As illustrated in FIGS. 5 and 8, the engaging member 8 includes the two base portions 80, a first pivot portion 81, a second pivot portion 82, a protruding portion 83, and a second urging member 84. The engaging member 8 is formed of synthetic resin in one unit. Each of the two base portions 80 has a cylindrical shape. The two base portions 80 respectively have through holes 80A each extending in the right and left direction. The center lines of the through holes 80A of the respective base portions 80 extend in the right and left direction and are located on the same straight line. The two base portions 80 are spaced apart from each other in the right and left direction and located on opposite sides of the second pivot portion 82 located at a substantially center of the engaging member 8 in the right and left direction.

Figure 7:
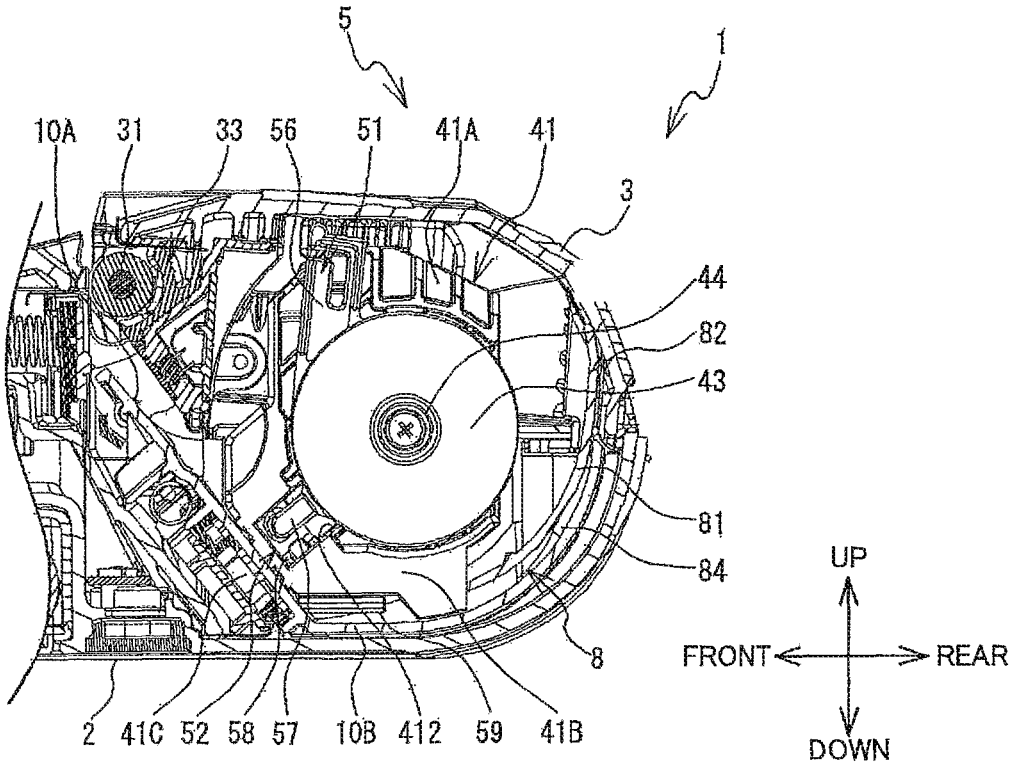
FIG. 7 is a cross-sectional view of components including the lock member and an engaging member.

Each of the first pivot portion 81 and the second pivot portion 82 is shaped like a curved plate. Specifically, as illustrated in FIG. 7, each of the first pivot portion 81 and the second pivot portion 82 has a substantially arc shape when viewed from the right side. When the cover 3 is in the closed state (see FIG. 10A), the center of the arc extending along the first pivot portion 81 and the second pivot portion 82 and the center of the rotation plates 43, 48 (see FIG. 3) supported by the pair of supporters 4 are substantially the same as each other in position. Thus, the center of the arc extending along the first pivot portion 81 and the second pivot portion 82 and the center of rotation of the roll M supported by the pair of supporters 4 are substantially the same as each other in position.

As illustrated in FIG. 8, the first pivot portion 81 has a rectangular shape elongated in the right and left direction. The two base portions 80 are connected to an upper end portion of the first pivot portion 81. The first pivot portion 81 extends downward, while curving, from its upper end portion to which the two base portions 80 are connected. That is, the first pivot portion 81 is a portion of the engaging member 8 which is located below the pivot axis of the engaging member 8. The length of the first pivot portion 81 in the right and left direction is slightly greater than the width of the roll M having the greatest width among the rolls M accommodatable in the accommodating portion 24. The first pivot portion 81 has a rectangular hole 81C at the center of the first pivot portion 81 in the right and left direction.

As illustrated in FIG. 8, the first pivot portion 81 has opposite end portions, namely, a first end portion 81A and a third end portion 81B to which the two base portions 80 are connected. Tooth portions 860-863, 870-873 having a substantially sawtooth shape are provided on the first end portion 81A. The tooth portions 860-863 may be hereinafter collectively referred to as "tooth portions 86", and the tooth portions 870-873 may be hereinafter collectively referred to as "tooth portions 87". Each of the tooth portions 86, 87 as one example of an engaging portion is formed in the first pivot portion 81 so as to be contactable with a corresponding one of the supporters 41, 46. The tooth portions 86 are provided to the left of a substantially center of the first end portion 81A. The tooth portions 87 are provided to the right of a substantially center of the first end portion 81A. That is, the tooth portions 860-863 are arranged side by side in this order from the substantially center of the first end portion 81A toward the left side, and the tooth portions 870-873 are arranged side by side in this order from the substantially center of the first end portion 81A toward the right side.

Each of the tooth portions 861-863 has a protruding shape and includes a distal end 86C, and a first extending portion 86A and a second extending portion 86B extending from the distal end 86C. The first extending portion 86A extends from the distal end 86C in a direction inclined rearward with respect to the right direction. In other words, the first extending portion 86A is inclined so as to extend toward the third end portion 81B of the first pivot portion 81 to which the two base portions 80 are connected. The second extending portion 86B extends rearward from the distal end 86C. In other words, the second extending portion 86B extends in a direction orthogonal to the right and left direction toward the third end portion 81B of the first pivot portion 81 to which the two base portions 80 are connected. Each of the tooth portions 861-863 has a substantially mountain shape. The tooth portion 860 is provided to the right of the tooth portion 861. The second extending portion 86B extends from the distal end 86C of the tooth portion 860 in the direction orthogonal to the right and left direction. The distal ends 86C of the respective tooth portions 860-863 are spaced uniformly in the right and left direction.

The tooth portions 87 are symmetrical in shape to the tooth portions 86 in the right and left direction. Each of the tooth portions 871-873 has a protruding shape and includes a distal end 87C, and a first extending portion 87A and a second extending portion 87B extending from the distal end 87C. The first extending portion 87A extends from the distal end 87C in a direction inclined rearward with respect to the left direction. In other words, the first extending portion 87A is inclined so as to extend toward the third end portion 81B of the first pivot portion 81 to which the two base portions 80 are connected. The second extending portion 87B extends rearward from the distal end 87C. In other words, the second extending portion 87B extends in the direction orthogonal to the right and left direction toward the third end portion 81B of the first pivot portion 81 to which the two base portions 80 are connected. Each of the tooth portions 871-873 has a substantially mountain shape. The tooth portion 870 is provided to the left of the tooth portion 871. The second extending portion 87B extends from the distal end 87C of the tooth portion 870 in the direction orthogonal to the right and left direction. The distal ends 87C of the respective tooth portions 870-873 are spaced uniformly in the right and left direction. The second extending portion 86B of the tooth portion 863 corresponds to a left end portion of the first pivot portion 81 of the engaging member 8. The second extending portion 87B of the tooth portion 873 corresponds to a right end portion of the first pivot portion 81 of the engaging member 8.

The distance between the distal end 86C of the tooth portion 860 and the distal end 87C of the tooth portion 870, the distance between the distal end 86C of the tooth portion 861 and the distal end 87C of the tooth portion 871, the distance between the distal end 86C of the tooth portion 862 and the distal end 87C of the tooth portion 872, and the distance between the distal end 86C of the tooth portion 863 and the distal end 87C of the tooth portion 873 are defined respectively as "L0", "L1", "L2", and "L3".

The protruding portion 83 is provided on the first pivot portion 81 at a position located nearer to the third end portion 81B than to the tooth portions 86, 87. The protruding portion 83 protrudes from an upper surface of the first pivot portion 81. The protruding portion 83 extends in a straight line over right and left end portions of the first pivot portion 81.

The second urging member 84 extends downward, while curving, from a portion of the hole 81C of the first pivot portion 81, which portion is located near the third end portion 81B. The second urging member 84 has a rectangular shape elongated in the up and down direction. An upper end of the second urging member 84 is connected to an upper end of the hole 81C. When viewed from the right side, the second urging member 84 has a substantially arc-shape (see FIGS. 5 and 7) in which a lower portion of the second urging member 84 is located at a rear of the first pivot portion 81 and an upper portion of the second urging member 84. A lower portion of the second urging member 84 is deformable elastically. In other words, the second urging member 84 serves as a leaf spring formed with the engaging member 8 as one unit.

The second pivot portion 82 has a rectangular shape elongated in the right and left direction. The second pivot portion 82 extends upward from a part of the third end portion 81B of the first pivot portion 81, which part is located between parts of the third end portion 81B to which the respective base portions 80 are connected. That is, the second pivot portion 82 is a portion of the engaging member 8 which is located above the pivot axis of the engaging member 8. The second pivot portion 82 has a second end portion 82A that is opposed to an end portion of the second pivot portion 82 which is connected to the first pivot portion 81. In other words, the second end portion 82A is opposed to the third end portion 81B to which the two base portions 80 are connected. The second pivot portion 82 is slightly bent frontward near the second end portion 82A. In the following description, a portion of the second end portion 82A which extends from the bent portion to the second end portion 82A may be referred to as "pressing portion 88". The pressing portion 88 as one example of a contact portion is formed in the second pivot portion 82 and contacts the cover 3.

As illustrated in FIGS. 2 and 4, the support shafts 28 are inserted in the through holes 80A formed in the respective base portions 80 of the engaging member 8. The engaging member 8 is supported by the two support shafts 28 so as to be pivotable about the two base portions 80 with respect to the main body 2. As illustrated in FIG. 7, a lower end of the second urging member 84 of the engaging member 8 is elastically deformed by contacting an inner surface of the rear end portion of the main body 2. As a result, the second urging member 84 serves as a leaf spring that urges in a direction in which the engaging member 8 pivots about the two base portions 80 in the clockwise direction.

Operations for Opening and Closing Cover

Figure 9A:
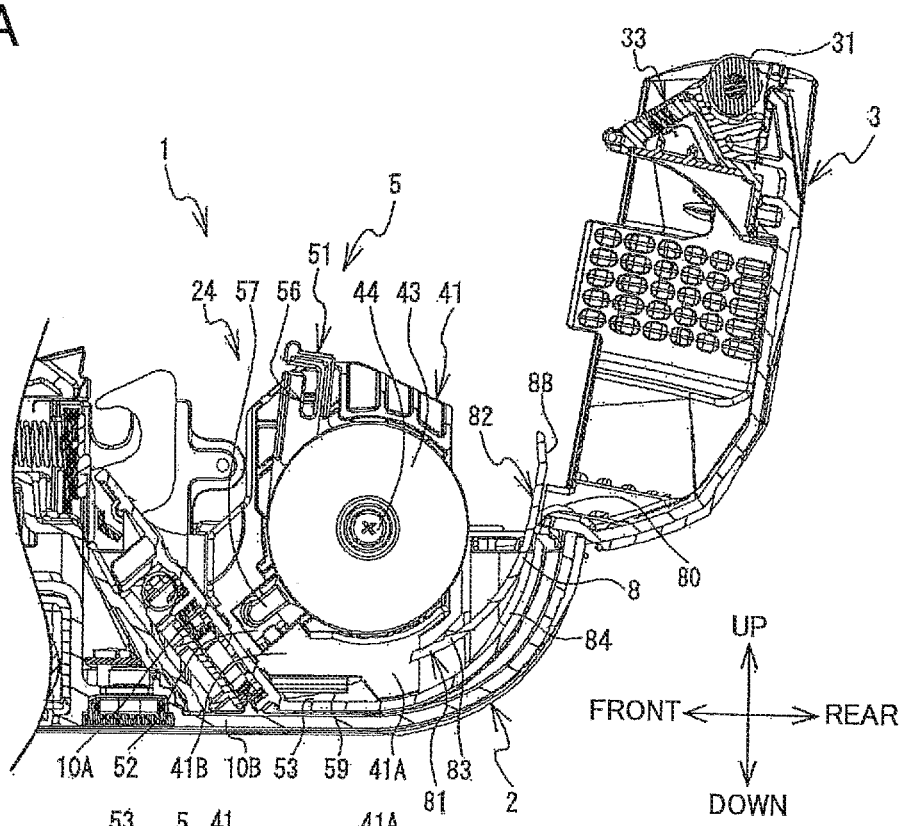
FIG. 9A is a cross-sectional view of the lock member and the engaging member in the state in which the cover is open.
Figure 9B:
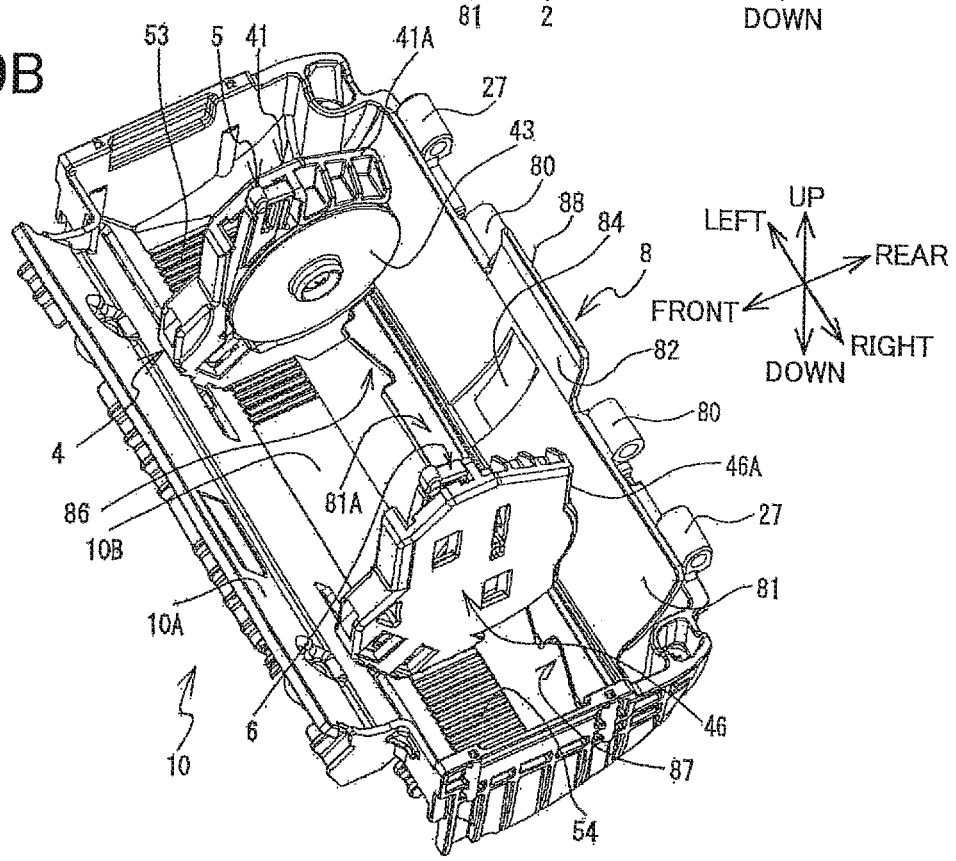
FIG. 9B is a perspective view of components including the engaging member located at an engaged position.

FIGS. 9A and 9B illustrate a state of the engaging member 8 and the lock member 5 in the case where the cover 3 is in the open state. In this case, as illustrated in FIG. 9A, the cover 3 does not contact the contact portion 56 of the first lock member 51. The first lock member 51 pivots in the clockwise direction by an urging force of the spring 41D. This pivotal movement obliquely moves the coupling portion 57 of the first lock member 51 toward the upper front side. Also, the pivotal movement of the first lock member 51 causes the second lock member 52 coupled to the coupling portion 57 to obliquely move toward the upper front side. The engaged portion 59 of the second lock member 52 is spaced apart from and located above the engaging portion 53 of the fixed portion 10B. The teeth 59A of the engaged portion 59 (see FIG. 6) are not engaged with the teeth of the engaging portion 53 (see FIG. 3). Thus, movement of the supporter 41 in the right and left direction is not inhibited, and the supporter 41 is freely movable in the right and left direction. It is noted that similar operations are performed for the lock member 6 though not explained. In the following description, a pivotal position of each of the lock members 5, 6 in a state in which movement of the supporters 41, 46 is not limited by the lock members 5, 6 may be referred to as "unlock position".

As illustrated in FIG. 9A, the cover 3 does not contact the pressing portion 88 of the second pivot portion 82 of the engaging member 8. In this state, the engaging member 8 is pivotable about the two base portions 80. The engaging member 8 pivots in the clockwise direction by the urging force of the second urging member 84, causing the first end portion 81A of the first pivot portion 81 (see FIG. 8) to move frontward. That is, in a process in which the cover 3 pivots from the closed state (see FIG. 10A) to the open state (see FIG. 9A), the cover 3 is separated from the second pivot portion 82, the second pivot portion 82 is moved away from the supporters 41, 46, and the first pivot portion 81 is moved toward the supporters 41, 46. Thus, as illustrated in FIG. 9B, the tooth portions 86, 87 of the first pivot portion 81 are located near the pair of supporters 4. The second extending portion 86B (see FIG. 8) of one of the tooth portions 86 is selectively in contact with a right surface of a rear end portion of the base portion 41A of the supporter 41 and is engaged with the supporter 41. The second extending portion 87B (see FIG. 8) of one of the tooth portions 87 is selectively in contact with a left surface of a rear end portion of the base portion 46A of the supporter 46 and is engaged with the supporter 46. In the following description, a pivotal position of the engaging member 8 in a state in which the pair of supporters 4 are engaged with the engaging member 8 may be referred to as "engaged position".

That is, when the cover 3 is in the open state, each of the lock members 5, 6 is located at the unlock position, and accordingly each of the supporters 41, 46 is to be moved in the approach direction by an urging force of the first urging member 75 of the adjusting mechanism 7 (see FIG. 5). However, since the engaging member 8 is located at the engaged position, the movement of each of the supporters 41, 46 in the approach direction is inhibited.

Figure 10A:
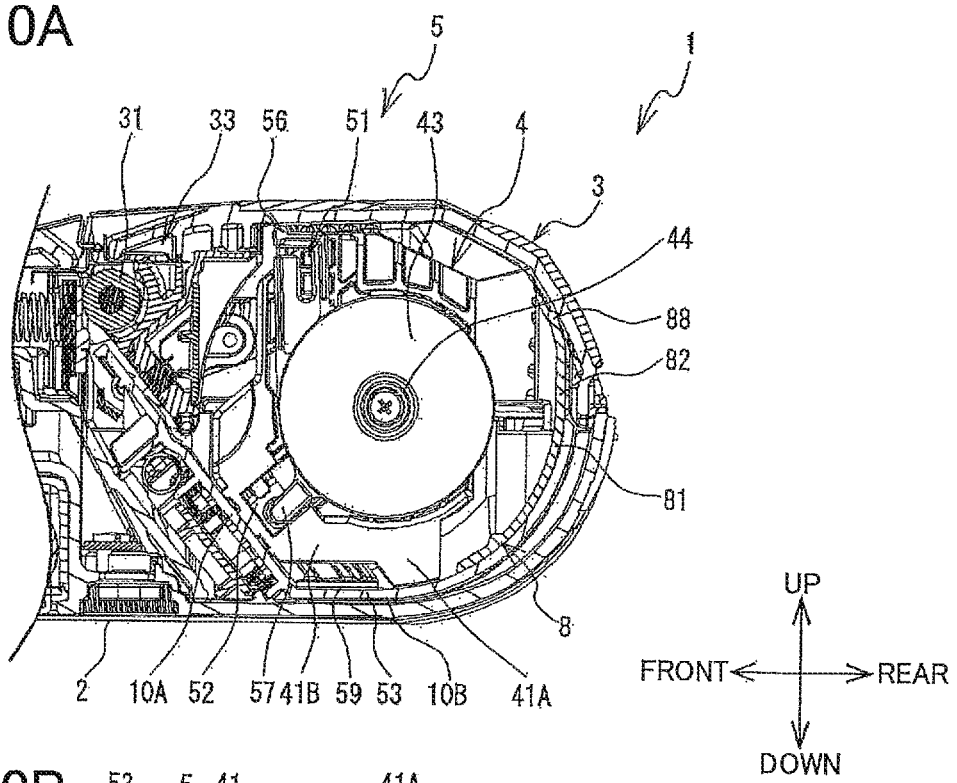
FIG. 10A is a cross-sectional view of the lock member and the engaging member in the state in which the cover is closed.
Figure 10B:
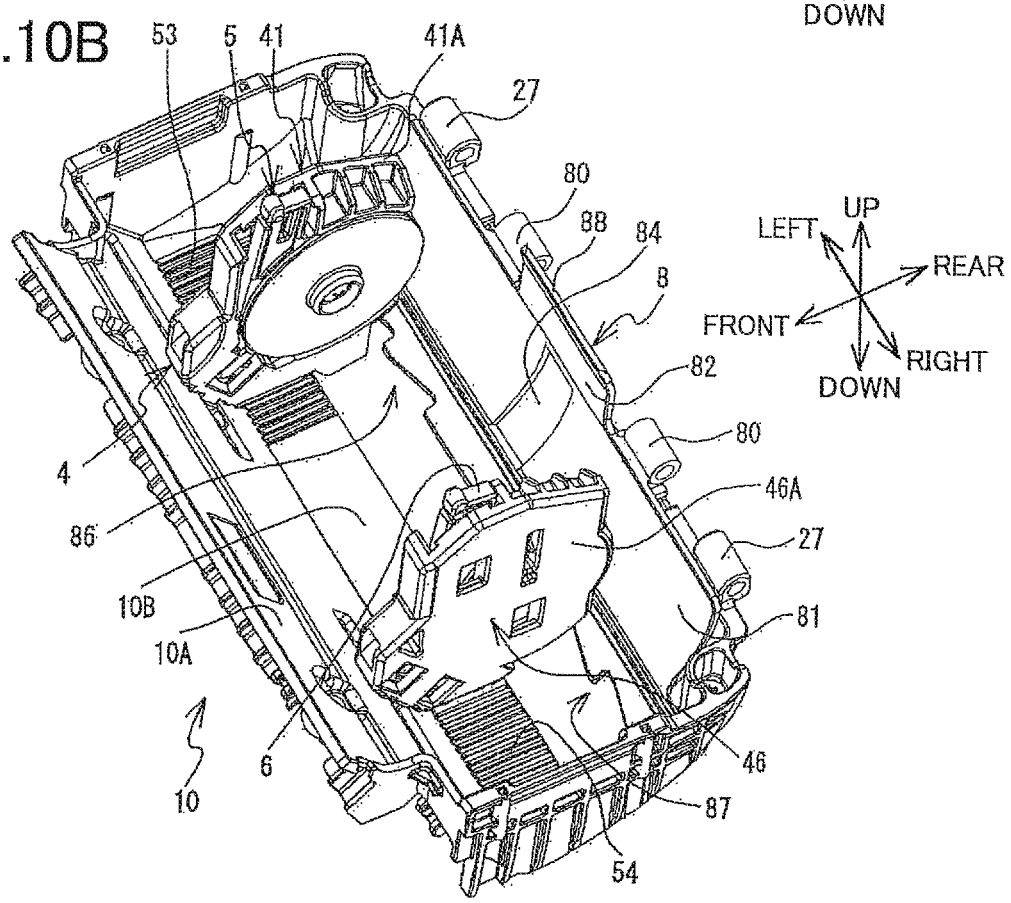
FIG. 10B is a perspective view of components including the engaging member located at a separated position.

FIGS. 10A and 10B illustrate a state of the engaging member 8 and the lock member 5 in the case where the cover 3 is in the closed state. In this case, as illustrated in FIG. 10A, a portion of the cover 3 near the platen holder 33 is in contact with the contact portion 56 of the first lock member 51. The first lock member 51 pivots in the counterclockwise direction against the urging force of the spring 41D. The coupling portion 57 of the first lock member 51 is obliquely moved toward the lower rear side. This pivotal movement causes the second lock member 52 coupled to the coupling portion 57 to obliquely move to the lower rear side. The teeth 59A of the engaged portion 59 of the second lock member 52 (see FIG. 6) are engaged with the teeth of the engaging portion 53 (see FIG. 3). Thus, the movement of each of the supporters 41, 46 in the right and left direction is inhibited by the lock member 5. It is noted that similar operations are performed for the supporter 46 and the lock member 6 though not explained. In the following description, a pivotal position of each of the lock members 5, 6 in the state in which the movement of each of the supporters 41, 46 is inhibited by a corresponding one of the lock members 5, 6 may be referred to as "lock position".

As illustrated in FIG. 10A, the cover 3 is in contact with the pressing portion 88 of the second pivot portion 82 of the engaging member 8. The engaging member 8 pivots about the two base portions 80 (see FIG. 8) in the counterclockwise direction against the urging force of the second urging member 84. The first end portion 81A of the first pivot portion 81 (see FIG. 8) moves rearward. As illustrated in FIG. 10B, the tooth portions 86, 87 of the first pivot portion 81 are separated from the pair of supporters 4. In the following description, a pivotal position of the engaging member 8 in the state in which the engaging member 8 is separated from the pair of supporters 4 may be referred to as "separated position". The engaging member 8 located at the separated position does not inhibit the movement of each of the supporters 41, 46 in the approach direction, which movement is caused by the urging force of the first urging member 75 of the adjusting mechanism 7.

That is, when the cover 3 is in the closed state, the engaging member 8 is located at the separated position, whereby each of the supporters 41, 46 is to be moved in the approach direction by the urging force of the first urging member 75 of the adjusting mechanism 7 (see FIG. 5). However, since each of the lock members 5, 6 is located at the lock position, the movement of each of the supporters 41, 46 in the approach direction is inhibited.

In a process in which the cover 3 pivots from the open state (see FIG. 9A) to the closed state (see FIG. 10A), the cover 3 is first brought into contact with the pressing portion 88 of the second pivot portion 82 of the engaging member 8, and the engaging member 8 is moved from the engaged position to the separated position. That is, a force is applied to the second pivot portion 82 from the cover 3, whereby the second pivot portion 82 is moved toward the supporters 41, 46, and the first pivot portion 81 is moved away from the supporters 41, 46. As a result, the engaging member 8 ceases inhibiting the movement of each of the supporters 41, 46 in the right and left direction. Here, since each of the lock members 5, 6 is located at the unlock position, each of the supporters 41, 46 moves in the approach direction by the urging force of the first urging member 75 of the adjusting mechanism 7. When the cover 3 further pivots, the cover 3 is brought into contact with the contact portion 56 of the first lock member 51 and the contact portion 66 of the first lock member 61. Thus, each of the lock members 5, 6 is moved from the unlock position to the lock position. As a result, the lock member 5 inhibits the movement of each of the supporters 41, 46 in the approach direction. That is, in the case where the cover 3 is changed from the open state (see FIG. 9A) to the closed state (see FIG. 10B), the engaging member 8 is first moved from the engaged position to the separated position, and then each of the lock members 5, 6 is moved from the unlock position to the lock position. FIG. 7 illustrates a positional relationship among the components in a state just before the cover 3 is changed to the closed state (see FIG. 10A).

Using Manner

The user changes the cover 3 to the open state to place the roll M into the accommodating portion 24 of the printing apparatus 1. In the open state of the cover 3, each of the lock members 5, 6 is located at the unlock position, and the engaging member 8 is located at the engaged position. Since the roll M is not contained in the accommodating portion 24 at this time, the supporters 41, 46 are respectively in contact with the second extending portions 86B, 87B of the most-inside tooth portions 860, 870 of the tooth portions 86, 87 of the engaging member 8, whereby the pair of supporters 4 are respectively engaged with the second extending portions 86B, 87B. Thus, the distance between the supporters 4 is kept at L0.

The user then operates the pair of supporters 4 to move each of the supporters 41, 46 in the away direction. This operation moves the supporter 41 leftward in a state in which the rear end portion of the base portion 41A of the supporter 41 is in contact with the first extending portion 86A of the tooth portion 861, and moves the supporter 46 rightward in a state in which the rear end portion of the base portion 46A of the supporter 46 is in contact with the first extending portion 87A of the tooth portion 871. In this movement, a force in the counterclockwise direction is applied to the engaging member 8, and accordingly the engaging member 8 pivots in the counterclockwise direction against the urging force of the second urging member 84. When the base portion 41A of the supporter 41 is moved to a left end portion of the first extending portion 86A of the tooth portion 861, and the base portion 46A of the supporter 46 is moved to a right end portion of the first extending portion 87A of the tooth portion 871, the force in the counterclockwise direction which is applied to the engaging member 8 is canceled. The urging force of the second urging member 84 causes pivotal movement of the engaging member 8 in the clockwise direction, so that the engaging member 8 moves back to the engaged position. As a result, the supporters 41, 46 are respectively in contact with the tooth portions 861, 871 of the respective second extending portions 86B, 87B of the engaging member 8, whereby the pair of supporters 4 are respectively engaged with the second extending portions 86B, 87B. The distance between the supporters 4 is kept at the distance L1. The user changes the distance between the supporters 4 to the distances L1, L2, L3 in the similar manner to increase the distance between the supporters 4 to a distance greater than the width (the width m) of the roll M.

It is noted that the user may adjust the distance between the supporters 4 in the following manner. The user presses the pressing portion 88 of the second pivot portion 82 of the engaging member 8 with his or her finger to forcibly move the engaging member 8 to the separated position. This enables the supporters 41, 46 to move in the right and left direction. Since each of the lock members 5, 6 is in the unlock state, the pair of supporters 4 are to move in the approach direction by the urging force of the first urging member 75. The user then moves each of the supporters 41, 46 in the away direction such that the distance between the supporters 4 is changed to any of the distances L1-L3 greater than the width m of the roll M. The user then ceases pressing the pressing portion 88 of the second pivot portion 82 of the engaging member 8. Each of the supporters 4 is brought into contact with and engaged with a corresponding one of the tooth portions 861-863 of the second extending portion 86B of the engaging member 8 and the tooth portions 871-873 of the second extending portion 87B of the engaging member 8. As a result, the distance between the supporters 4 is kept at any of the distances L1-L3 greater than the width m of the roll M.

It is noted that, in the above-described operation, the user may, independently of the width m of the roll M, operate the pair of supporters 4 such that the supporters 41, 46 are respectively in contact with the second extending portions 86B, 87B of the most-outside tooth portions 863, 873 of the tooth portions 86, 87 of the engaging member 8, and thereby the pair of supporters 4 are respectively engaged with the second extending portions 86B, 87B. As a result, the distance between the supporters 4 is kept at the distance L3, so that all the rolls M usable in the printing apparatus 1 are accommodatable in the printing apparatus 1.

In this state, the user places the roll M between the supporters 4 and then closes the cover 3. In a process in which the cover 3 is changed from the open state to the closed state, the engaging member 8 is first moved from the engaged position to the separated position. Since each of the lock members 5, 6 is in the unlock state, the pair of supporters 4 are to move in the approach direction by the urging force of the first urging member 75 of the adjusting mechanism 7. The rotation plates 43, 48 come into contact with the respective left and right end portions of the roll M, so that the movement of each of the pair of supporters 4 in the approach direction is stopped.

When the cover 3 is further closed, each of the lock members 5, 6 is moved from the unlock position to the lock position. The movement of each of the supporters 4 in the approach direction is inhibited by a corresponding one of the lock members 5, 6 in a state in which the rotation plates 43, 48 are respectively in contact with left and right surfaces of the roll M. The roll M is rotatably supported by the rotation plates 43, 48 from opposite sides of the roll M. This enables printing on the thermal label wound around the roll M after the cover 3 is changed to the closed state.

Figure 11:
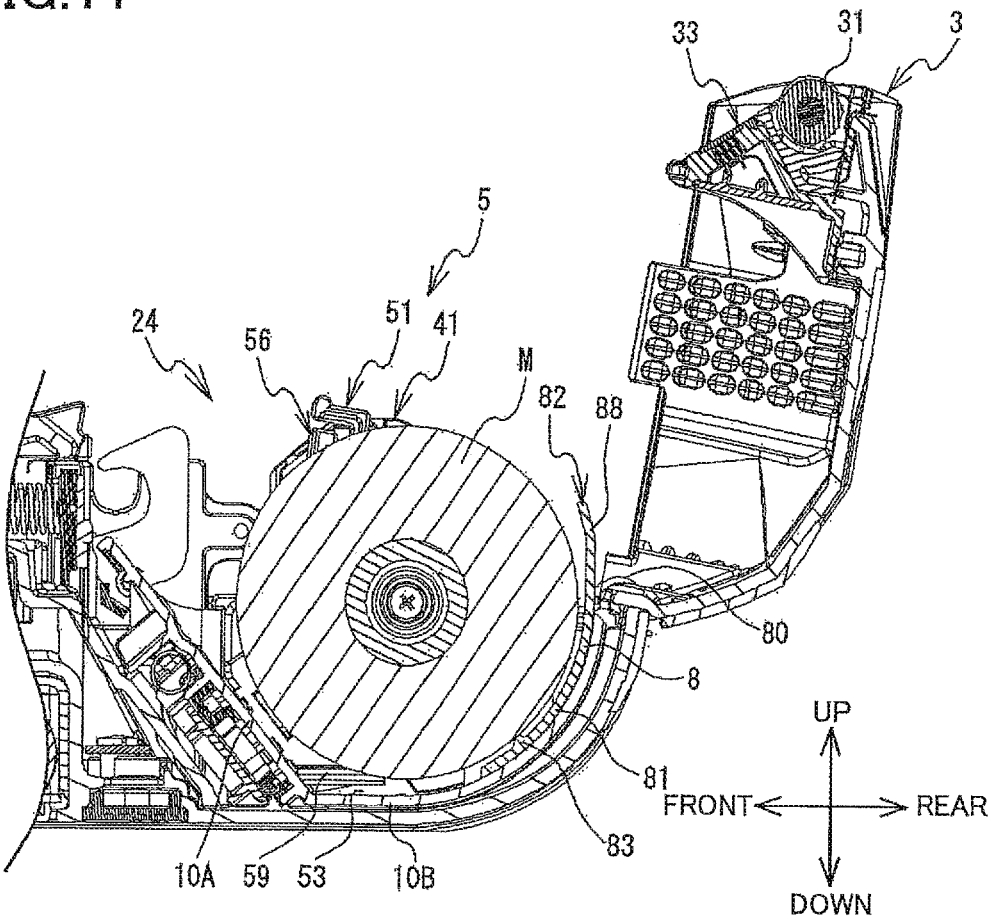
FIG. 11 is a cross-sectional view of the lock member and the engaging member in a state in which the cover is open, and a roll is contained in the accommodating portion.

It is noted that, as illustrated in FIG. 11, in the case where the roll M having an outside diameter greater than or equal to a predetermined diameter is placed between the supporters 4, an outer circumferential surface of the roll M is pressed against the protruding portion 83 of the engaging member 8. A force in the counterclockwise direction is applied to the engaging member 8 from the roll M. The engaging member 8 pivots in the counterclockwise direction against the urging force of the second urging member 84 and moves from the engaged position to the separated position. The tooth portions 86, 87 of the first pivot portion 81 are separated from the respective supporters 4. Each of the supporters 4 is moved in the approach direction by the urging force of the first urging member 75 of the adjusting mechanism 7. That is, in the case where the roll M having an outside diameter greater than or equal to the predetermined diameter is placed between the supporters 4, the state in which the rotation plates 43, 48 are in contact with the respective left and right surfaces of the roll M is established before the cover 3 is closed. This stabilizes the position of the roll M even in the case where the user has changed the cover 3 to the open state. Here, the roll M having an outside diameter greater than or equal to the predetermined diameter refers to a new roll M, for example.

It is noted that, even in the case where the roll M having an outside diameter less than the predetermined diameter is secured to the pair of supporters 4, for example, the user may press the pressing portion 88 of the second pivot portion 82 of the engaging member 8 with his or her finger to forcibly move the engaging member 8 to the separated position. In this case, the tooth portions 86, 87 of the first pivot portion 81 are separated from the respective supporters 4, and each of the supporters 4 is moved in the approach direction by the urging force of the first urging member 75 of the adjusting mechanism 7. That is, even in the case where the roll M having an outside diameter less than the predetermined diameter is placed between the supporters 4, the state in which the rotation plates 43, 48 are in contact with the respective left and right surfaces of the roll M can be established before the cover 3 is closed. Here, the roll M having an outside diameter less than the predetermined diameter refers to a partially used roll M, for example.

Operations and Effects in Present Embodiment

As described above, the position of the engaging member 8 of the printing apparatus 1 is changed between the engaged position (see FIGS. 9A and 9B) and the separated position (see FIGS. 10A and 10B), depending upon the open/closed state of the cover 3. In the state in which the cover 3 is open (see FIGS. 9A and 9B), the engaging member 8 is located at the engaged position to inhibit the movement of each of the supporters 4 in the approach direction. That is, the pair of supporters 4 are held in a state in which the supporters 4 are spaced apart from each other at a particular distance (any of the distances L1-L3). This configuration allows the user to easily secure the roll M to the supporters 4 spaced apart from each other at the particular distance, without the need for the user to hold the supporters 4 such that the supporters 4 do not move in the approach direction. In this case, the user can easily secure the roll M with one hand.

In the state in which the cover 3 is closed (see FIGS. 10A and 10B), the pressing portion 88 of the engaging member 8 contacts the cover 3, whereby the engaging member 8 is moved to the separated position. In this movement, the movement of the pair of supporters 4 in the right and left direction is not inhibited by the engaging member 8. Thus, each of the supporters 4 can be moved in the approach direction, whereby the supporters 4 reliably hold the roll M contained in the accommodating portion 24, from the opposite sides of the roll M in the right and left direction. Accordingly, the printing apparatus 1 can prevent skew of the tape drawn from the roll M.

In a process in which the cover 3 is changed from the open state to the closed state, the engaging member 8 is first moved to the separated position to enable the movement of the pair of supporters 4 in the right and left direction. With this configuration, each of the supporters 4 is moved in the approach direction by the urging force of the first urging member 75 of the adjusting mechanism 7. As a result, the supporters 4 are moved toward each other respectively to positions near opposite ends of the roll M, contained in the accommodating portion 24, in the right and left direction. Each of the lock members 5, 6 then inhibits the movement of the corresponding one of the supporters 4 in the right and left direction. The supporters 4 held near the respective opposite ends of the roll M in the right and left direction are immovably held by the respective lock members 5, 6. Accordingly, in the printing apparatus 1, the operation of placing the supporters 4 to positions near the respective opposite ends of the roll M in the right and left direction and an operation of inhibiting the movement of the supporters 4 in this state can be performed in conjunction with user's operation of closing the cover 3.

In the printing apparatus 1, when the cover 3 is in the open state, and the engaging member 8 is located at the engaged position, each of the supporters 4 is brought into contact with a corresponding one of the tooth portions 86, 87 of the engaging member 8 to inhibit the movement of each of the supporters 4 in the approach direction. This configuration allows the user to easily secure the roll M to a position between the supporters 4. In the printing apparatus 1, when the cover 3 is changed from the open state to the closed state, the cover 3 is pressed against the pressing portion 88 of the engaging member 8, whereby the engaging member 8 is moved from the engaged position to the separated position. This movement enables each of the supporters 4 to move in the approach direction. This configuration enables the pressing portion 88 of the engaging member 8 to serve as a mechanism that enables each of the supporters 4 to move in the approach direction in conjunction with the operation of closing the cover 3.

The tooth portions 86, 87 have a substantially sawtooth shape. Each of the tooth portions 86, 87 has a substantially mountain shape including the corresponding one of the first extending portions 86A, 87A, and the corresponding one of the second extending portions 86B, 87B extending from the corresponding one of the distal ends 86C, 87C each having the protruding shape. Each of the first extending portions 86A, 87A extends from the corresponding one of the distal ends 86C, 87C in a direction inclined toward the base portions 80 with respect to the approach direction. This configuration allows the user to, when the cover 3 is open, easily move each of the supporters 4 in the away direction in a state in which each of the supporters 4 is in contact with a corresponding one of the first extending portions 86A, 87A of the engaging member 8. Each of the second extending portions 86B, 87B extends from the corresponding one of the distal ends 86C, 87C toward the corresponding one of the base portions 80 in the rear direction orthogonal to the right and left direction. Thus, the supporters 4 are brought into contact with the second extending portions 86B, 87B of the respective tooth portions 86, 87, whereby the engaging member 8 appropriately inhibits the movement of each of the supporters 4 in the approach direction.

The second urging member 84 is the elastically-deformable leaf spring formed with the engaging member 8 as one unit. This configuration simplifies the configuration of the second urging member 84, resulting in reduced manufacturing cost of the engaging member 8.

The first pivot portion 81 of the engaging member 8 has the protruding portion 83. The outer circumferential surface of the roll M contained in the accommodating portion 24 is pressed against the protruding portion 83, whereby the engaging member 8 is rotated in the counterclockwise direction and moved from the engaged position to the separated position. In this case, each of the supporters 4 is movable in the approach direction by the urging force of the first urging member 75 of the adjusting mechanism 7 in the state in which the roll M is contained in the accommodating portion 24. Thus, in the case where the roll M is placed into the accommodating portion 24 when the cover 3 is in the open state, each of the pair of supporters 4 is moved in the approach direction, whereby the supporters 4 hold the roll M from the opposite sides thereof in the right and left direction. It is noted that the center of the arc extending along the first pivot portion 81 and the center of rotation of the roll M supported by the pair of supporters 4 are substantially the same as each other in position. With this configuration, a force with which the roll M presses the protruding portion 83 can be efficiently transmitted to the engaging member 8 via the protruding portion 83.

Both of the cover 3 and the engaging member 8 are pivotably supported by the support shafts 28. This configuration enables the cover 3 to pivot with respect to the main body 2 to open and close the opening portion 20 of the accommodating portion 24. The engaging member 8 pivots with respect to the main body 2 to move between the engaged position and the separated position. Thus, it is possible to provide commonality of the support shafts 28 for supporting the cover 3 pivotably and the support shafts 28 for supporting the engaging member 8 pivotably. This configuration reduces the number of components of the printing apparatus 1 and facilitates assembly of the printing apparatus 1. Also, since the support shafts 28 provide the commonality of the pivot shafts for supporting the cover 3 and the engaging member 8, a force related to the operation of closing the cover 3 can be efficiently transmitted to the engaging member 8.

The engaging member 8 is curved, and the center of the arc extending along the first pivot portion 81 and the second pivot portion 82 and the center of rotation of the roll M supported by the pair of supporters 4 are substantially the same as each other in position. In this case, a structure engageable with the pair of supporters 4 can be made as large as possible as long as the structure is accommodatable in the accommodating portion 24.

Modifications

It is to be understood that the disclosure is not limited to the details of the illustrated embodiment, but may be embodied with various changes and modifications, which may occur to those skilled in the art, without departing from the spirit and scope of the disclosure. Only one of the supporters 4 may be movable in the right and left direction. For example, the pair of supporters 4 may be configured such that only the supporter 41 is movable in the right and left direction, and the supporter 46 is fixed to the accommodating portion 24. In this configuration, the pair of supporters 4 may be configured such that the lock member 5 is provided for the movable supporter 41, and the lock member 6 is not provided for the supporter 46. The engaging portions 53, 54 may be provided on the inner wall of the main body 2. Each of the first lock members 51, 61 may be coupled to the cover 3 via a linkage mechanism, for example. The linkage mechanism may cause pivotal movement of each of the first lock members 51, 61 when the cover 3 is moved from the open state to the closed state. In this case, the first lock members 51, 61 may not include the respective contact portions 56, 66.

In the case where the cover 3 is changed from the open state to the closed state, the timing at which each of the supporters 4 becomes movable in the approach direction by the movement of the engaging member 8 and the timing at which the lock members 5, 6 inhibit movement of the pair of supporters 4 may be made substantially the same as each other.

The engaging member 8 may be slidable with respect to the main body 2. In this configuration, the engaging member 8 is urged in a direction directed from the separated position toward the engaged position, and when the cover 3 is brought into contact with the pressing portion 88, the engaging member 8 is slid against the urging force of the engaging member 8 and moved from the engaged position to the separated position. The tooth portions 860-863 may not be spaced uniformly, and the tooth portions 870-873 may not be spaced uniformly. That is, the tooth portions 860-863 may be spaced at different distances, and the tooth portions 870-873 may be spaced at different distances. For example, the distance between each adjacent two of the tooth portions 860-863 may be determined such that the distance between each two away-direction-side tooth portions is greater than corresponding two approach-direction-side tooth portions or such that the distance between each two away-direction-side tooth portions is less than the corresponding two approach-direction-side tooth portions. Likewise, the distance between each adjacent two of the tooth portions 870-873 may be determined such that the distance between each two away-direction-side tooth portions is greater than corresponding two approach-direction-side tooth portions or such that the distance between each two away-direction-side tooth portions is less than the corresponding two approach-direction-side tooth portions. The shape of each of the tooth portions 860-863, 870-873 is not limited to the substantially mountain shape and may be any shape having a protrusion (or protrusions) and a recession (or recessions).

The second urging member 84 may not be formed on the engaging member 8 as one unit. For example, the printing apparatus 1 may be configured such that a leaf spring independent of the engaging member 8 is employed as the second urging member 84 and mounted on the engaging member 8 or the rear end portion of the main body 2. This leaf spring may be formed of any of synthetic resin and metal. The second urging member 84 may be a torsion coil spring. In this configuration, this torsion coil spring may be mounted on each of the support shafts 28. The protruding portion 83 may not be provided on the engaging member 8. The support shaft for supporting the cover 3 and the support shaft for supporting the engaging member 8 pivotably may be different from each other.

Associations

Each of the supporters 41, 46 is one example of a movable supporter. The right and left direction is one example of a widthwise direction. The up and down direction is one example of an intersecting direction.

What is claimed is:

1. A printing apparatus, comprising:

a main body comprising an accommodating portion configured to accommodate a roll of a printing medium, the accommodating portion having an opening on one side in an intersecting direction intersecting a widthwise direction of the roll;

a cover being openable and closable so as to cover the opening of the accommodating portion;

a pair of supporters provided in the accommodating portion and configured to support opposite portions of the roll in the widthwise direction, the pair of supporters comprising a movable supporter movable in the widthwise direction, the movable supporter being at least one of the pair of supporters;

a lock member configured to perform: inhibiting movement of the movable supporter when the cover is in a closed state; and not inhibiting the movement of the movable supporter when the cover is in an open state;

a first urging member configured to urge the movable supporter in an approach direction of the widthwise direction, the approach direction being a direction in which the distance between the pair of supporters decreases;

an engaging member movable between a separated position at which the engaging member is spaced apart from the movable supporter and an engaged position at which the engaging member is engaged with the movable supporter to inhibit the movement of the movable supporter in the approach direction; and a second urging member configured to urge the engaging member from the separated position toward the engaged position, wherein when the cover is in the open state, the engaging member is located at the engaged position by an urging force of the second urging member so as to inhibit the movement of the movable supporter in the approach direction, which movement is caused by an urging force of the first urging member, and wherein when the cover is in the closed state, the engaging member is located at the separated position against the urging force of the second urging member by contact of the cover with the engaging member so as not to inhibit the movement of the movable supporter in the approach direction, which movement is caused by the urging force of the first urging member.

2. The printing apparatus according to claim 1, wherein the cover is configured to cover the opening of the accommodating portion at a position over the engaging member, wherein the engaging member is supported by the main body so as to be pivotable about a pivot axis extending in the widthwise direction, and wherein the engaging member comprises:

an engaging portion engageable with the movable supporter and formed on a first pivot portion which is a portion of the engaging member and which is located below the pivot axis; and a contact portion contactable with the cover and formed on a second pivot portion which is a portion of the engaging member and which is located above the pivot axis.

3. The printing apparatus according to claim 2, wherein when the cover is changed from the open state to the closed state, the second pivot portion receives a force from the cover and is moved toward the movable supporter, and the first pivot portion is moved away from the movable supporter.

4. The printing apparatus according to claim 3, wherein when the cover is changed from the closed state to the open state, the cover is separated from the second pivot portion, and the second pivot portion is moved away from the movable supporter, and the first pivot portion is moved toward the movable supporter.

5. The printing apparatus according to claim 1, wherein when the cover is changed from the open state to the closed state, the engaging member is moved from the engaged position to the separated position to enable the movement of the movable supporter in the approach direction, and the lock member thereafter inhibits the movement of the movable supporter.

6. The printing apparatus according to claim 1, wherein the engaging member comprises: a base portion having a pivot center; and a first pivot portion and a second pivot portion extending respectively in different directions with respect to the base portion, wherein the engaging member is configured to pivot with respect to the main body to move between the separated position and the engaged position, wherein the base portion is pivotably supported by a support shaft provided on the main body and extending in the widthwise direction, wherein the first pivot portion comprises a plurality of tooth portions arranged in the widthwise direction, each having a protruding shape, and provided on an outer portion, in the widthwise direction, of a first end portion that is one of opposite end portions of the first pivot portion, which one is farther from the base portion than another of the opposite end portions of the first pivot portion, wherein the second pivot portion comprises a pressing portion which is configured to be pressed by the cover when the cover is closed, and which is provided at a second end portion that is one of opposite end portions of the second pivot portion, which one is farther from the base portion than another of the opposite end portions of the second pivot portion, and wherein when the cover is in the open state, any one of the plurality of tooth portions of the engaging member located at the engaged position is in contact with the movable supporter, and wherein when the cover is changed from the open state to the closed state, the second pivot portion is pressed, and the engaging member is moved from the engaged position to the separated position.

7. The printing apparatus according to claim 6, wherein the plurality of tooth portions have a substantially sawtooth shape, wherein each of the plurality of tooth portions has a substantially mountain shape and comprises a first extending portion and a second extending portion extending from a distal end of said each of the plurality of tooth portions, and the distal end has a protruding shape, wherein the first extending portion is inclined with respect to the approach direction of the widthwise direction so as to extend from the distal end toward the base portion, and wherein the second extending portion extends from the distal end in a direction directed toward the base portion and orthogonal to the widthwise direction.

8. The printing apparatus according to claim 1, wherein the engaging member and the second urging member are formed as one unit, and wherein the second urging member is a leaf spring deformable elastically.

9. The printing apparatus according to claim 6, wherein the engaging member comprises a protruding portion provided on the first pivot portion, and wherein an outer circumferential surface of the roll accommodated in the accommodating portion is pressed against the protruding portion, causing the engaging member to be moved from the engaged position to the separated position.

10. The printing apparatus according to claim 6, wherein the cover is pivotably supported by the support shaft and configured to pivot with respect to the main body to open and close the opening of the accommodating portion.

* * * * *